US007249721B2

(12) United States Patent
Niass et al.

(10) Patent No.: US 7,249,721 B2
(45) Date of Patent: Jul. 31, 2007

(54) DEVICE AND METHOD FOR INJECTING A LIQUID FUEL INTO AN AIR FLOW FOR A COMBUSTION CHAMBER

(75) Inventors: Tidjani Niass, Lyons (FR); Gérard Martin, Saint Genis Laval (FR); Etienne Lebas, Seyssuel (FR); Guy Grienche, Coarraze (FR); Gérard Schott, Rontignon (FR); Hubert Verdier, Nay (FR)

(73) Assignees: Institut Francais du Petrole, Rueil Malmaison Cedex (FR); Turbomeca, Bordes Cedex (FR)

( * ) Notice: Subject to any disclaimer, the term of this patent is extended or adjusted under 35 U.S.C. 154(b) by 0 days.

(21) Appl. No.: 10/477,127

(22) PCT Filed: Apr. 22, 2002

(86) PCT No.: PCT/FR02/01381

§ 371 (c)(1),
(2), (4) Date: Nov. 7, 2003

(87) PCT Pub. No.: WO02/090831

PCT Pub. Date: Nov. 14, 2002

(65) Prior Publication Data

US 2004/0142294 A1 Jul. 22, 2004

(30) Foreign Application Priority Data

May 10, 2001 (FR) ..... 01 06218

(51) Int. Cl.
*F02C 7/22* (2006.01)
*F02C 7/26* (2006.01)
*F23R 3/14* (2006.01)

(52) U.S. Cl. ..... 239/399; 239/402; 239/403; 431/173; 60/748

(58) Field of Classification Search ..... 60/776, 60/742, 737, 748, 39.55; 431/173; 239/399, 239/403, 402
See application file for complete search history.

(56) References Cited

U.S. PATENT DOCUMENTS 3,866,413 A * 2/1975 Sturgess ..... 60/742

(Continued)

FOREIGN PATENT DOCUMENTS

| | | |
|---|---|---|
| EP | 0762057 | 3/1997 |
| EP | 0981019 | 2/2000 |
| WO | 9516881 | 6/1995 |

OTHER PUBLICATIONS

Wang et al, "Experimental Study of a Model Gas Turbine Combustor Swirl Cup, Part II: Droplet Dynamics", Journal of Propulsion and Power, vol. 19, No. 4, Jul.-Aug. 1994, pp. 446-452.*

*Primary Examiner*—Ted Kim
(74) *Attorney, Agent, or Firm*—Antonelli, Terry, Stout & Kraus, LLP.

(57) ABSTRACT

The present invention relates to a device for injecting a liquid fuel into a pressurized air flow (7), in particular for a combustion chamber, comprising a hollow cylindrical body (10) of longitudinal axis (YY') delimiting a substantially cylindrical central volume (11), fluid veins (12) substantially radial in relation to the longitudinal axis of body (10) and arranged on the periphery of said body to allow passage of said flow, and axial fuel injection pipes (5) arranged inside said fluid veins and connected to at least one fuel inlet (3) by at least one supply point (16). According to the invention, pipes (5) are pierced with openings (9) that open onto central volume (11) of said body (10) and which are oriented substantially in the direction of the flow in fluid veins (12).

6 Claims, 3 Drawing Sheets

U.S. PATENT DOCUMENTS 5,319,935 A * 6/1994 Toon et al. ..... 60/733
5,423,173 A * 6/1995 Lemon et al. ..... 60/776
5,588,824 A 12/1996 McMillan
6,094,916 A 8/2000 Smith
6,109,038 A * 8/2000 Sharifi et al. ..... 60/737
6,151,899 A * 11/2000 Park ..... 60/748
6,216,466 B1 * 4/2001 Alkabie ..... 60/746
6,253,555 B1 * 7/2001 Willis ..... 60/737
6,532,726 B2 * 3/2003 Norster et al. ..... 60/737
6,868,676 B1 * 3/2005 Haynes ..... 60/776

* cited by examiner

DEVICE AND METHOD FOR INJECTING A LIQUID FUEL INTO AN AIR FLOW FOR A COMBUSTION CHAMBER

FIELD OF THE INVENTION

The present invention relates to a device and to a method for injecting a liquid fuel into an air flow allowing to obtain a homogeneous fuel/air mixture in a combustion chamber.

The invention finds applications in particular in the sphere of onshore gas turbines by allowing to obtain, during operation of said turbine, a high energy efficiency together with a low pollutant production.

BACKGROUND OF THE INVENTION

In conventional combustion chambers for gas turbines, the main priority is to obtain a stable combustion in a wide range of operating conditions.

In order to reach this goal in the most effective way, a combustion is conventionally first carried out under conditions close to stoichiometry with part of the air coming from the compressor, and the fumes obtained are then progressively diluted with another part of the air coming from this compressor so as to lower their temperature to the thermal level allowable by the expander.

This approach however has the disadvantage of generating large amounts of nitrogen oxides (also referred to as thermal $NO_x$) because of the very high temperatures reached in the combustion zone (flame temperatures typically ranging between 2000 and 2400° C.).

In order to comply with the new environmental regulations, gas turbine manufacturers are currently trying to develop units that can operate at full capacity, i.e. under high loads, without producing large amounts of air pollutants.

The pollutants generally produced by gas turbines during the combustion of hydrocarbons are, as mentioned above, nitrogen oxides, as well as carbon monoxide and unburned hydrocarbons. Besides, it is well-known that the oxidation of molecular nitrogen to thermal $NO_x$ in the combustion chambers of turbines greatly depends on the maximum temperature of the hot gases in the reactive zone.

The formation of nitrogen oxides can thus be represented by an increasing exponential function of the temperature. It ensues therefrom that it is possible to limit the formation of nitrogen oxides by preventing gas temperature peaks in the combustion chamber.

Several methods have been proposed for this purpose:

According to a first operating method, it has been suggested to inject water or steam into the combustion chamber to reduce the temperature peaks, which has the beneficial effect of limiting the formation of nitrogen oxides of thermal origin.

This solution is however difficult to implement compared with the results obtained because it requires sophisticated treatment of the water in order to remove all the impurities, as well as a steam generator in the case of steam injection, and it can be reasonably envisaged only for very big machines. Furthermore, lowering of the temperature considerably slows down the oxidation reaction of the hydrocarbons, which sometimes leads to a combined increase in the emission level of carbon monoxide and of unburned hydrocarbons.

Another solution consists in carrying out a multistage combustion, with a rich step and a lean step, the shift from one to the other occurring very quickly. Here again, the temperature peaks generating nitrogen oxides $NO_x$ are reduced and the rich zone allows their formation to be limited, but this solution leads to a significant production of unburned hydrocarbons.

A third solution for controlling both the temperature and the discharge of pollutants consists, prior to combustion, in mixing the air and the fuel in form of a lean mixture so as to obtain a fuel/air ratio ranging between 0.3 and 1, preferably between 0.5 and 0.8.

The air mass present in excess in the reaction zone thus absorbs part of the heat generated by the oxidation reaction of the fuel and reduces the temperature to which the reaction products are subjected. Furthermore, the cooling air requirements for adjusting the temperature at the expander inlet are markedly lower. This method thus efficiently allows to limit the production of nitrogen oxides without substantially increasing the emissions level of the other pollutants (hydrocarbons, carbon monoxide, etc.).

The main problem posed by an operation under lean mixture conditions is that premixing has to be sufficiently homogeneous and uniform to reach the desired low emissions level.

It is thus possible, for a non-uniform distribution of the fuel in the air in the combustion zone, that the presence of excess fuel in certain areas leads to the existence of hot spots, which has as a consequence the uncontrolled formation of nitrogen oxides. Similarly, in other areas of very low fuel/air ratio, local cooling prevents combustion and eventually leads to gaseous and solid unburned residues.

Besides, whereas mixing of a gaseous fuel with air occurs through the effects of molecular scattering and above all of the kinetic energy ratio between the fuel and the air, and of the spatial distribution of the injection points, mixing of a liquid fuel with air additionally requires prior spraying which conditions the quality of the mixture and therefore of the combustion.

In fact, since combustion always occurs in the gas phase, it is necessary to change the fuel into a cloud of droplets with the smallest possible diameter, evaporation of said fuel being all the faster as the diameter of the liquid droplets is small. This fuel evaporation is often carried out in two stages by means of systems provided, on the one hand, with a vaporizing chamber and, on the other hand, with liquid fuel injectors. The vaporization quality generally depends on the geometry of the vaporizing chamber.

U.S. Pat. No. 6,094,916 provides for example a device wherein mixing of the air and of the fuel is carried out under pressure by means of a fixed device equipped with radial blades generating a rotating motion of the fluid flow. A fuel injection pipe is axially positioned between each blade of the device. The fuel is injected through openings provided in the pipes with an opening angle of 60° to a radial direction of said device.

Such a layout is not suitable for injecting a fuel in liquid form because, in this case, it would have the effect of sending said fuel directly on the blades of the device, with the inevitable consequence of the formation of coke on the walls thereof, leading to considerable damage in terms of performance, lifetime of the materials of the device and emissions level of the turbine. Furthermore, it has been found by the applicant that such an injection does not allow optimum spraying and homogeneous mixing with air in case of injection of a liquid fuel.

SUMMARY OF THE INVENTION

The object of the present invention thus is a device allowing to obtain a homogeneous lean mixture of fuel and air prior to combustion.

According to the present invention, it is possible to obtain a stable flame throughout the range of operating conditions of a gas turbine working under lean burn conditions.

Thus, a device for injecting a liquid fuel into a pressurized air flow, in particular for a combustion chamber, comprising a hollow cylindrical body of longitudinal axis delimiting a substantially cylindrical central volume, fluid veins substantially radial in relation to the longitudinal axis of the body and arranged on the periphery of said body to allow passage of said flow, and axial fuel injection pipes arranged inside said veins and connected to at least one fuel inlet by at least one supply point, is characterized in that said pipes are pierced with openings that open onto the central volume of said body and which are oriented substantially in the direction of the flow in the fluid veins.

According to another feature, the median axis of the veins can form an angle ranging between 20° and 60° with the radius of the cylindrical body.

Advantageously, the fluid veins can have a three-dimensional shape calculated to minimize the pressure drops caused as the air flow under pressure flows through the veins.

The openings can be linearly distributed in the axial direction of the fuel injection pipes.

The fuel injection pipes can have a variable inner section according to the distance to the fuel supply point of said pipe.

In a variant, the device can also comprise axial pipes for injecting a gaseous fuel, said pipes being pierced with openings that open onto said central cylindrical volume and oriented substantially perpendicular to the direction of the flow in the fluid veins.

The gaseous fuel injection pipes can be arranged, in relation to the direction of the air flow under pressure in the fluid veins, upstream from the liquid fuel injection pipes.

According to the invention, a method of injecting a liquid fuel into an air flow under pressure is characterized in that the following stages are carried out:

pressurized air is sent into a volume upstream from at least one combustion zone, a swirling motion of the air is generated in said volume by causing the air flow under pressure to pass through a plurality of passages arranged on the periphery of said volume, the liquid fuel is injected into said passages substantially in the direction of the pressurized air flow.

Advantageously, air can be injected into said volume in such a way that its velocity ranges from about 10 m/s to about 200 m/s.

Alternatively, a gaseous fuel can be injected into said passages substantially perpendicular to the direction of the pressurized air flow.

Water can be injected in liquid form or in form of steam as a substitute for the fuel.

BRIEF DESCRIPTION OF THE FIGURES

Other features and advantages of the device and/or of the method according to the invention will be clear from reading the description hereafter of embodiments given by way of non limitative example, with reference to the accompanying drawings wherein.

DETAILED DESCRIPTION

The terms <<upstream>> and <<downstream>> are used in the present description in relation to the direction of circulation of the air in the present device.

Figure 1:
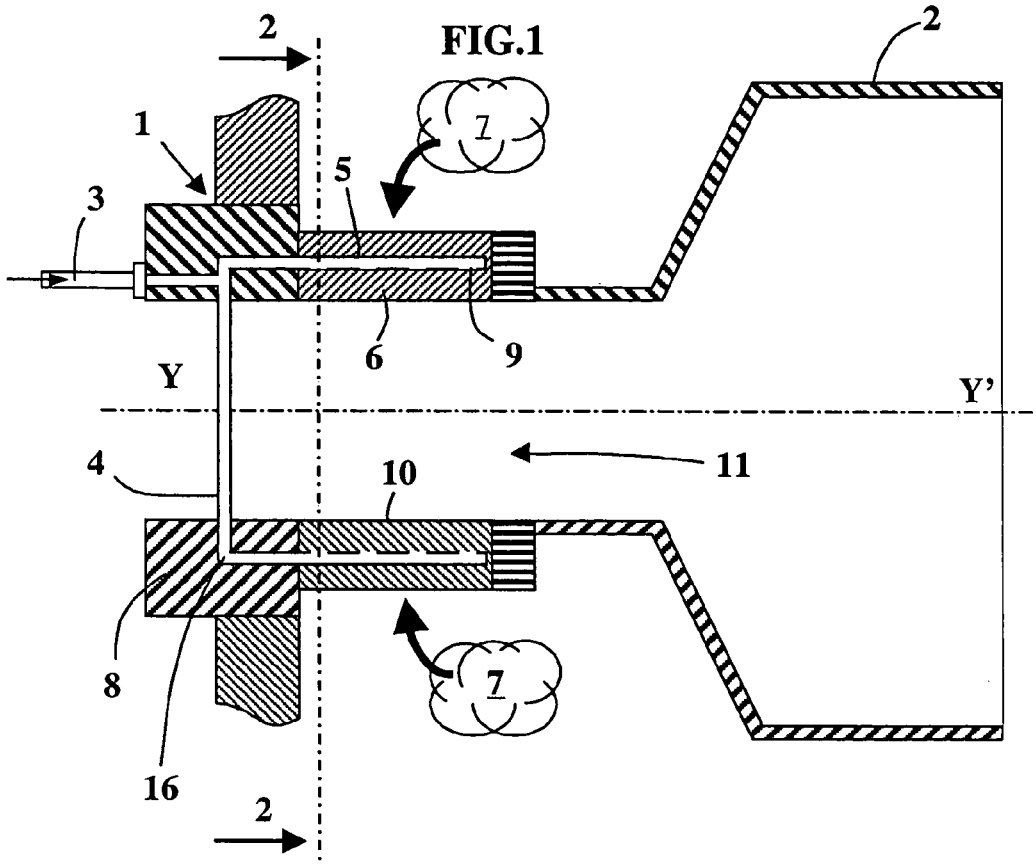
FIG. 1 is a partial cross-sectional view of an injection device according to the invention.

FIG. 1 is a cross-sectional view of a fuel injection and air supply device 1 opening onto a combustion chamber 2 of a pilot stage or of a main stage of a gas turbine for example.

This device 1, of longitudinal axis YY', comprises a liquid fuel inlet pipe 3 leading said fuel to a delivery pipe or ramp 4 of substantially annular shape. A multiplicity of channels or pipes 5 communicating with pipe 4 by means of injection points 16 extend substantially axially in the space contained between two blades 6 of a hollow body 10 of substantially cylindrical shape, this space forming a vein 12 allowing passage of the fluid, as can be seen more clearly in FIG. 2.

Figure 2:
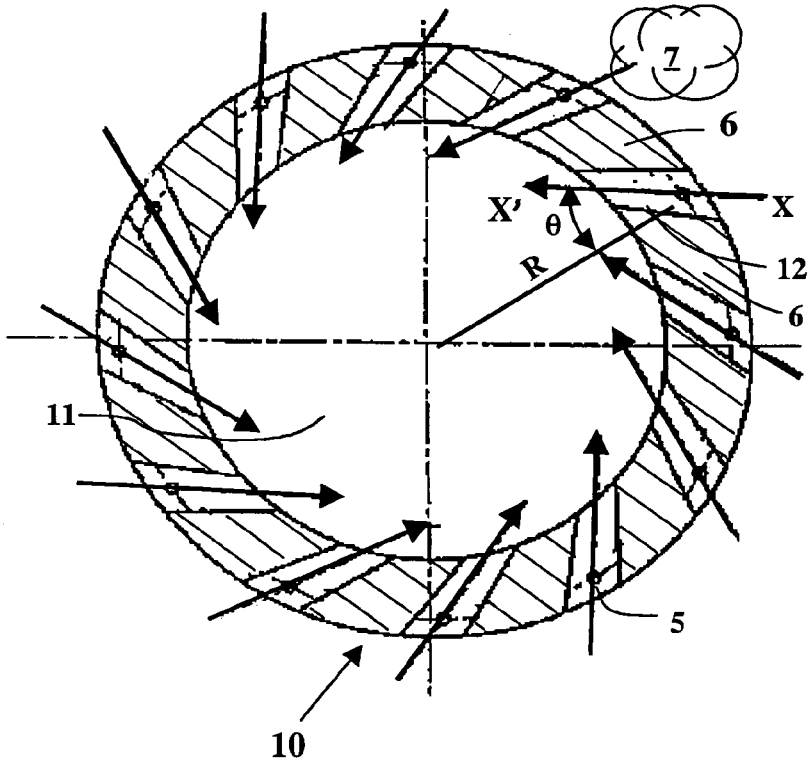
FIG. 2 is a cross-sectional view along line 2-2 of FIG. 1.

Hollow body 10 delimits a central zone 11 whose cross-section is illustrated by FIG. 2. A swirling motion of the air due to its passage between blades 6 allows better stabilization of the combustion by favouring recirculation of the combustion gases in space 11 and in combustion chamber 2.

Pipes 5 are provided, over the total length thereof, with openings 9 that open substantially in the direction of flow of the air in veins 12 and allowing injection of the liquid fuel in a substantially radial way between said blades, as well as mixing of this fuel with air 7 flowing in, for example, under pressure from the compressor of the turbine (not shown).

Hollow body 10 is secured to a fixed part 8 of the device by means of a known technique.

FIG. 2 diagrammatically shows a cross-section of cylindrical body 10 shown in FIG. 1.

The pressurized air flows through hollow cylindrical body 10 through fluid veins 12 delimited by blades 6. The median axis XX' of veins 12 forms an angle θ with radius R between the centre of body 10 and the centre of pipe 5. Angle θ is selected by the man skilled in the art in such a way that the swirling motion in central zone 11 optimizes recirculation of the combustion gases. Angle θ thus generally ranges between 20° and 60°.

A liquid fuel injection pipe 5 is placed in each vein 12. In the pattern illustrated by FIG. 2, there are thus twelve fluid veins 12 evenly distributed along the circumference of body 10 and allowing passage of pressurized air 7, delimited by twelve blades 6 between which twelve fuel injection pipes 5 are inserted.

Of course, this embodiment is given by way of illustration and the number of blades, their shape and the shape of the fluid veins allowing passage of the air will be optimized according to the technical characteristics of the device by the man skilled in the art, by means of any known technique.

Figure 3A:
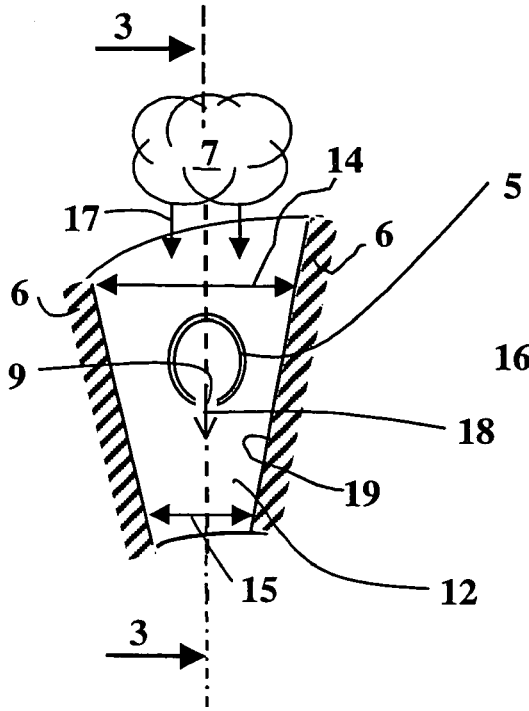
FIG. 3A is a larger-scale local view showing a detail of the device according to the invention.
Figure 3B:
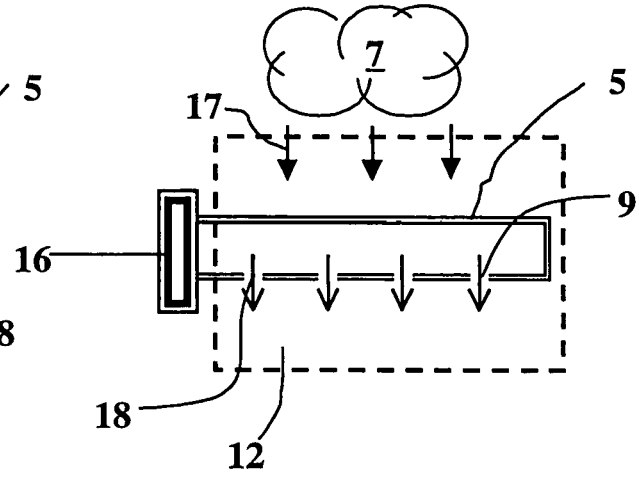
FIG. 3B is a cross-sectional view along line 3-3 of FIG. 3A.

FIGS. 3A and 3B respectively show a cross section and a longitudinal section of a fluid vein 12 and of pipe 5 present therein.

Pressurized air 7 flows through fluid veins 12 as shown by arrows 17 and it mixes therein with the fuel coming from an injection point 16 and flowing out of openings 9 in a direction illustrated by arrows 18. Arrows 17 and 18 are colinear in FIGS. 3A and 3B, i.e. said pipes 5 are pierced with openings that open onto the central volume of the hollow cylindrical body substantially in the direction of flow of the air in the fluid veins.

This pattern has the advantage, within the context of a liquid injection, of limiting the formation of coke on walls 19 of the blades and of improving in fluid veins 12, on the one hand, mixing of the air and of the fuel and, on the other hand, spraying of said fuel downstream from pipes 5 according to the principles described above.

Thus, it has been found by the applicant that the turbulence zone in the wake of pipe 5, generated by the high-velocity flow of air 7, greatly favours spraying of the liquid fuel and contributes to improving the homogeneity of the air/fuel mixture in said zone. The work done within the framework of the present invention has also shown that the velocity of flow of the air has to be of the order of some ten m/s, preferably of the order of about 100 m/s, while the velocity of the fuel has to be as low as possible (of the order of 0.1 m/s to 10 m/s, preferably between about 0.5 m/s and 2 m/s) to favour said spraying and said mixing.

As shown in these figures, the cross section of the fluid veins, illustrated by arrows 14 and 15, exhibits a significant narrowing from upstream to downstream so as to increase the velocity of the air therein and therefore the turbulence of the flow.

This layout advantageously allows to improve mixing of the air and of the fuel and spraying of the fuel in fluid veins 12. However, the cross section of veins 12 can be rectangular or have any other shape known to the man skilled in the art in order to optimize the pressure drop caused by the air flowing through the device. Furthermore, it can be provided with a throttle system allowing to adjust the flow of air of the combustion stage according to the load of the turbine, which facilitates reduced load running.

Thus, a very homogeneous lean-burn mixture generating a stable combustion whatever the running conditions considered is obtained at the outlet of the fluid veins according to the device illustrated by FIGS. 1, 2 and 3A, 3B.

Besides, the swirling motion of the fluids in central space 11, generated by their flow through veins 12 of body 10, allows in addition recirculation of the hot combustion products, which also favours stabilization of said combustion whatever the running conditions in the combustion chamber.

Figure 4:
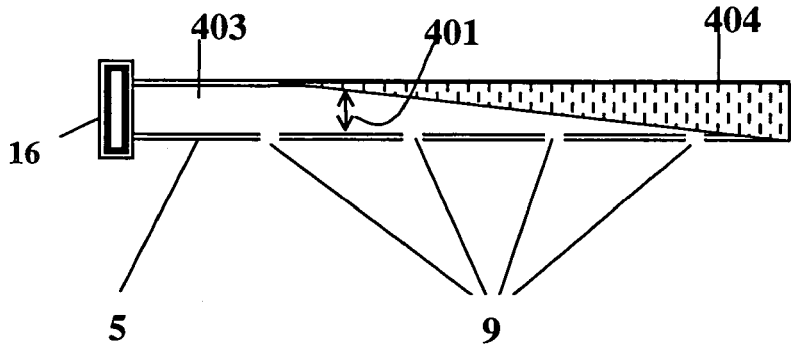
FIG. 4 shows a longitudinal section of a possible embodiment of the liquid fuel injection pipes, FIGS. 5A and 5B diagrammatically show, in two views similar to the views of FIGS. 3A and 3B, a variant of the invention.

FIG. 4 illustrates a possible embodiment of a liquid fuel injection pipe 5 according to the invention.

This pipe has an evolutional section 401 which is a function of the distance to fuel injection point 16 in said pipe.

The pipe thus comprises two distinct parts: a hollowed part 403 providing passage of the fuel to injection openings 9 and a solid part 404 made according to any technique known to the man skilled in the art so as to progressively limit the section of flow of the fuel in said pipe from the vicinity of injection point 16 up to its free end. This layout allows to maintain a substantially identical fuel flow rate in a simple and economical way for each opening 9.

The work done by the applicant shows that, for such a pipe, the average diameter of the droplets at the outlet of the fluid veins is substantially independent of the air/fuel mass flow rate ratio and that said average diameter is substantially constant over the total outlet section of the fluid veins. This property allows to keep the same spraying performances for different running conditions of the combustion chamber.

Figure 5A:
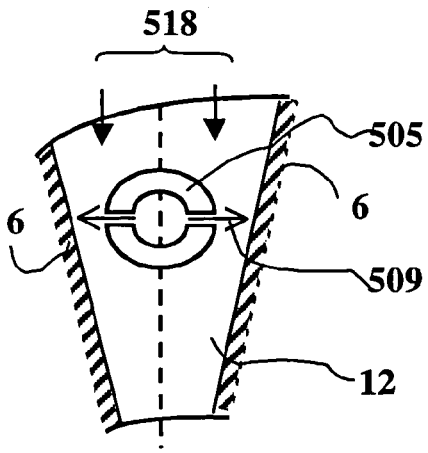
Figure 5B:
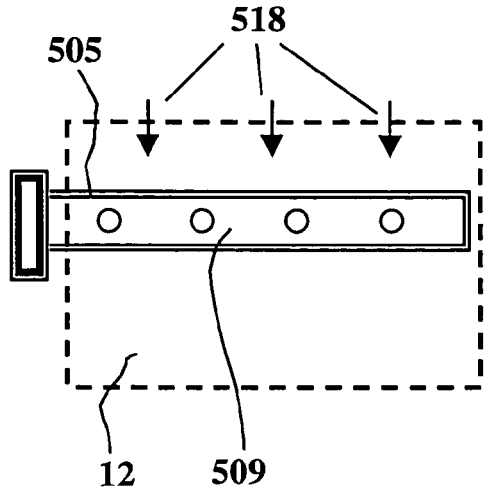

A particular embodiment of the invention is illustrated by FIGS. 5A and 5B, which respectively show a cross-section and a longitudinal section of a fluid vein 12 and of a pipe 505 for injecting a gaseous fuel present therein.

Unlike the liquid injection system described in connection with FIGS. 3A and 3B, injection openings 509 are oriented perpendicular to the mean direction of flow of the air in the fluid veins. The velocity of the mixture is, in this embodiment, all the more efficient as the ratio between the velocities of the gaseous fuel and of the air is high Without departing from the scope of the invention, the embodiments described in connection with FIGS. 3A, 3B and 5A, 5B can be combined to allow liquid-gas bicarburetion supply and operation of the combustion chamber.

The gaseous fuel supply to the gaseous fuel injection pipes can be carried out through a second delivery pipe of substantially annular shape and substantially similar to the pipe shown in connection with FIG. 1.

Figure 6:
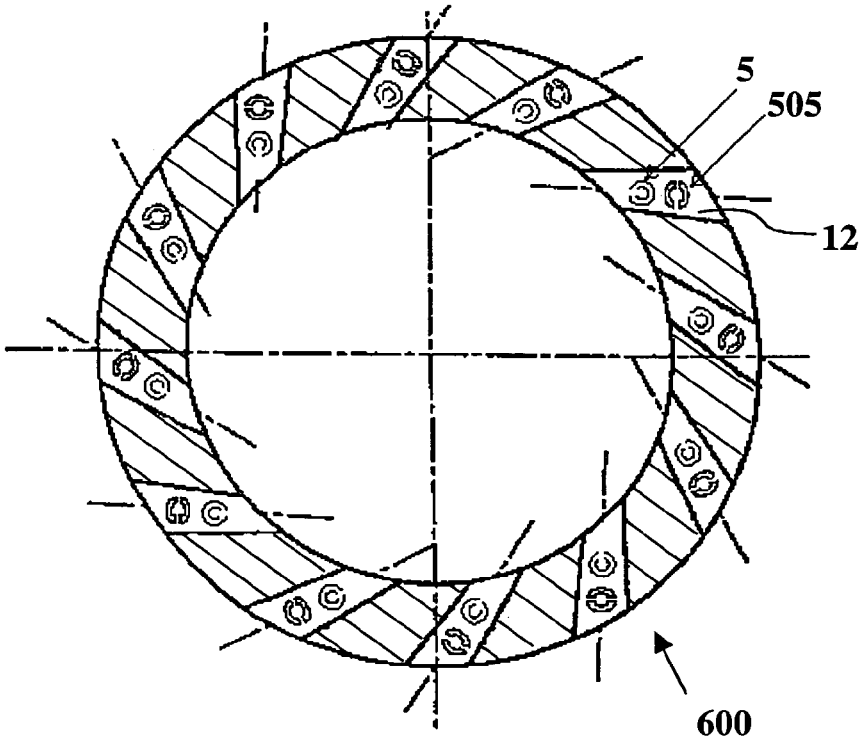
FIG. 6 illustrates another embodiment of the invention.

FIG. 6 diagrammatically shows a cross-section of a cylindrical body 600 similar to the body described in connection with FIG. 2, and associated with an injection device allowing liquid-gas bicarburetion running.

This bicarburetion is obtained by combining, within a single device, liquid fuel injection pipes and gaseous fuel injection pipes such as those described above in connection with FIGS. 3A, 3B and 5A, 5B. Between blades 6 of the hollow cylindrical body, pipes 5 are dedicated to the injection of liquid fuel and pipes 505 allow injection of a gaseous fuel. Pipes 505 are arranged in the fluid veins upstream from pipes 5.

The use of two delivery ramps leading to distinct injection pipes in a gas turbine combustion chamber provides high flexibility because it allows to use, alternately or in the same cycle, a gaseous fuel or a liquid fuel, without modifying the fuel supply system and without stopping the turbine. Furthermore, the injection system remains compact and advantageously allows to shift from one to the other in case of ramp damage (gas or liquid) or in case of fuel (gas or liquid) supply problems.

Without departing from the scope of the invention, it is possible to use, during operation of the present device, one of the two pipes 5 or 505 as described above to inject either water in liquid form or steam into the combustion chamber. This procedure affords the advantage, according to the prior art described above, of decreasing nitrogen oxides emissions.

The present device and/or the present method, although it finds an obvious application, is not limited to the sphere of gas turbines, and its use can also be considered in any combustion device or method requiring delivery of a fuel in liquid form and homogeneous mixing of said fuel and air prior to said combustion.

The invention claimed is:

1. An injection device for injecting a liquid fuel into a pressurized air flow, in particular for a combustion chamber, comprising a hollow cylindrical body having a longitudinal axis and delimiting a substantially cylindrical central volume, fluid veins extending in a direction substantially at an acute angle with a radius of said cylindrical body and arranged on the periphery of said body to allow passage of said pressurized air flow into said central volume of said cylindrical body, and liquid fuel injection pipes arranged within said fluid veins and connected to at least one liquid fuel inlet by at least one liquid fuel supply point, characterized in that said pipes are pierced with openings that open onto said central volume of said cylindrical body and which are oriented substantially in the direction of the flow in said fluid veins, wherein said liquid fuel injection pipes have a variable inner section according to the distance to said at least one liquid fuel supply point of said pipe.

2. An injection device as claimed in claim 1, wherein median axis of said veins forms an angle (θ) ranging between 20° and 60° with the radius of said cylindrical body.

3. An injection device as claimed in claim 1, wherein said fluid veins have a three-dimensional shape calculated to minimize the pressure drops caused as pressurized air flow flows through said fluid veins.

4. An injection device as claimed in claim 1, wherein said openings are arranged linearly in the axial direction of said liquid fuel injection pipes.

5. An injection device as claimed in claim 1, further comprising axial injection pipes intended for a gaseous fuel, said pipes being pierced with openings that open onto said central cylindrical volume and oriented substantially perpendicular to the direction of flow in said fluid veins.

6. An injection device as claimed in claim 5, wherein said gaseous fuel injection pipes are positioned, in relation to the direction of flow of the pressurized air in said fluid veins, upstream from said liquid fuel injection pipes.

* * * * *